US007108584B2

(12) United States Patent
Yamamoto

(10) Patent No.: US 7,108,584 B2
(45) Date of Patent: Sep. 19, 2006

(54) METHOD AND APPARATUS FOR MANUFACTURING LIQUID DROP EJECTING HEAD

(75) Inventor: Ryoichi Yamamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 100 days.

(21) Appl. No.: 10/255,100

(22) Filed: Sep. 26, 2002

(65) Prior Publication Data

US 2003/0071011 A1 Apr. 17, 2003

(30) Foreign Application Priority Data

Sep. 26, 2001 (JP) ..... 2001-293684

(51) Int. Cl.
*B24B 1/00* (2006.01)

(52) U.S. Cl. ..... 451/29; 451/38; 347/20; 216/2; 216/41; 216/52; 216/67

(58) Field of Classification Search ..... 451/38, 451/39, 29, 89, 78; 134/6, 7; 356/630; 438/622; 204/192.33; 216/2, 41, 52, 67; 347/20, 347/44, 54; 156/345.1
See application file for complete search history.

(56) References Cited

U.S. PATENT DOCUMENTS 5,315,793 A * 5/1994 Peterson et al. ..... 451/2
5,364,472 A * 11/1994 Heyns et al. ..... 134/7
5,387,314 A * 2/1995 Baughman et al. ..... 216/27
5,409,418 A * 4/1995 Krone-Schmidt et al. ..... 451/75
5,589,041 A * 12/1996 Lantsman ..... 204/192.33
5,651,834 A * 7/1997 Jon et al. ..... 134/31
5,766,061 A * 6/1998 Bowers ..... 451/89
5,895,313 A * 4/1999 Ikezaki et al. ..... 451/38
5,928,434 A * 7/1999 Goenka ..... 134/2
6,214,720 B1 * 4/2001 Sill et al. ..... 438/622
6,226,086 B1 * 5/2001 Holbrook et al. ..... 356/630
6,422,920 B1 * 7/2002 Bouten et al. ..... 451/29
6,757,973 B1 * 7/2004 Park ..... 29/890.1

FOREIGN PATENT DOCUMENTS

JP 2000-127402 5/2000

* cited by examiner

*Primary Examiner*—Jacob K. Ackun, Jr.
(74) *Attorney, Agent, or Firm*—Whitham, Curtis, Christofferson & Cook, PC

(57) ABSTRACT

The method and apparatus manufacture a liquid drop ejecting head. The method and apparatus blast particles on a substrate having on an upper layer a patterned mask layer made of an organic material and on a lower layer a driver circuit for ejecting a liquid drop to thereby perform an etching process on parts of the substrate exposed from the mask layer. The etching process is performed in an ionic atmosphere ionized with a polarity opposite to a charged polarity generated in the substrate when the substrate is subjected to etching.

21 Claims, 3 Drawing Sheets

METHOD AND APPARATUS FOR MANUFACTURING LIQUID DROP EJECTING HEAD

BACKGROUND OF THE INVENTION

1. Field of the Invention

The present invention relates to a manufacturing method for a liquid drop ejecting head and a manufacturing apparatus therefor, in which particles are blasted onto a substrate provided with mask layers which are patterned in advance and are made of an organic material, thereby etching or sandblasting portions exposed from the mask layers on the substrate surfaces. More specifically, the present invention relates to a method and an apparatus for manufacturing an ink ejecting head in which ink drops are ejected for recording an image or the like to a recording medium.

2. Description of the Related Art

Recording heads of a thermal ink jet printer are manufactured in such a way that driver integrated circuits are formed on a semiconductor substrate such as a silicon substrate; a plurality of heating resistors are formed in the vicinity thereof; individual ink passages that constitute ink passages corresponding to the respective heating resistors are formed above the respective heating resistors; common ink passages to be connected to the individual ink passages are formed; and ink jet nozzles for ejecting ink fed from the individual ink passages as ink drops are further formed.

When supplying ink to a recording head of a thermal ink jet printer, for instance, in the case of a top shooter type where the ink drop is ejected substantially in the perpendicular direction to the silicon substrate, since the supply of the ink to the recording head of the thermal ink jet printer is effected from the back surface side of the silicon substrate, at least one ink supply port that passes through the silicon substrate is formed in the silicon substrate during the above-described manufacturing process. The ink supply port is thus connected to the ink groove which is provided on the top surface side of the silicon substrate and is in communication with the above-described common ink passage.

In this case, since each of the ink supply ports and the ink grooves to be formed has a large depth, the ink supply ports passing through the silicon substrate or the ink grooves connected to the ink supply ports are commonly formed by sandblasting from the top and back surface sides of the silicon substrate in view of the processing speed. As is well known in the sandblasting method, a resist made of an organic material is used as a mask layer in the area other than the area where the etching is to be effected, and particles having a small diameter are blasted at a predetermined speed on the silicon substrate and the like, to thereby perform mechanical etching of the silicon substrate and the like. Such a sandblasting method is described in JP 2000-127402A.

SUMMARY OF THE INVENTION

In the sandblasting method, static electricity is generated due to the friction between the fine particles and air, because the fine particles are blasted with the air. Accordingly, in the case where the ink supply ports and the ink grooves were formed in the silicon substrate by sandblasting, there arose a problem in that the fine particles charged with the static electricity cause the driver integrated circuit formed underneath the mask layer to be charged through the mask layer, which prevents the operation of the driver integrated circuit thereby electrostatically damaging the driver integrated circuit.

The problems of the operation failure and the electrostatic damage of the driver integrated circuit due to such charge are not limited to those which occur during the manufacture of a recording head of a thermal ink jet printer, but are general problems similarly caused when forming grooves and holes by using the sandblasting method in a manufacturing process of a liquid drop ejecting head having an MOS-FET circuit or the like for ejecting liquid drops.

Accordingly, in order to overcome the above-noted defects, an object of the present invention is therefore to provide a method for manufacturing a liquid drop ejecting head in which particles are blasted onto a substrate having mask layers which are made of an organic material and are patterned on a top layer of the substrate surface where a driver circuit for ejecting liquid drops is formed, and the parts of the substrate exposed from the mask layers are subjected to etching, which enables reduction of the potential of the charged driver circuit provided on the substrate such as a silicon substrate and prevention of electrostatic damage of the driver circuit during the manufacture of the liquid drop ejecting head.

Another object of the present invention is to provide an apparatus for manufacturing a liquid drop ejecting head to which the above method is applied.

In order to attain the object described above, the present invention provides a manufacturing method for a liquid drop ejecting head, comprising: blasting particles on a substrate having on an upper layer a patterned mask layer made of an organic material and on a lower layer a driver circuit for ejecting a liquid drop; and thereby performing an etching process on parts of the substrate exposed from the mask layer, wherein the etching process is performed in an ionic atmosphere ionized with a polarity opposite to a charged polarity generated in the substrate when the substrate is subjected to etching.

Preferably, the ionic atmosphere is produced by blowing ion blow toward a substrate surface of the substrate.

Preferably, the ionic atmosphere is produced by ionizing compressed air for blasting particles during the etching process.

Preferably, the particles are conductive particles.

Preferably, the etching process is a sandblasting process.

The present invention provides a manufacturing apparatus for a liquid drop ejecting head having: an etching device for blasting particles on a substrate having on an upper layer a patterned mask layer made of an organic material and on a lower layer a driver circuit for ejecting a liquid drop and for etching parts of the substrate exposed from the mask layer; and an ion gas blowing device for blowing ion blow ionized with a polarity opposite to a charged polarity generated in the substrate toward a substrate surface of the substrate to be etched by the etching device.

Preferably, the ion gas blowing device is an ion gas blower for blowing the ion blow toward the substrate surface of the substrate separately from compressed air for blasting particles upon etching by the etching device.

Preferably, the ion gas blowing device ionizes compressed air for blasting particles upon etching by the etching device so as to provide the ion blow and blows it.

Preferably, the particles are conductive particles.

Preferably, the etching device is a sandblasting device.

DESCRIPTION OF THE PREFERRED EMBODIMENTS

A method and an apparatus for manufacturing a liquid drop ejecting head according to the present invention will now be described in detail with reference to the preferred embodiments shown in the accompanying drawings.

Figure 1:
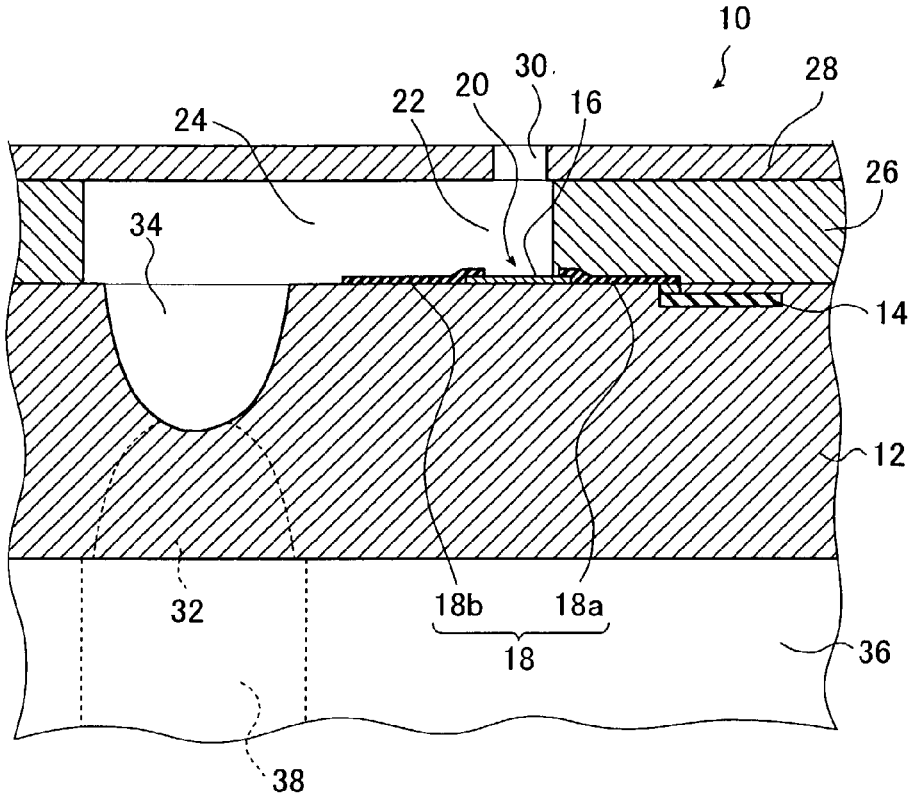
FIG. 1 is a cross-sectional view showing an overview of an embodiment of an ink ejecting head manufactured in accordance with the manufacturing method for a liquid drop ejecting head of the present invention.

FIG. 1 shows an embodiment of a cross-sectional structure of a head corresponding to one ink jet nozzle of an ink ejecting head 10 to be manufactured by using the manufacturing method for a liquid drop ejecting head according to the present invention. A plurality of ink jet nozzles arranged in one direction each have such a head structure.

The ink ejecting head 10 shown in FIG. 1 comprises a silicon substrate 12; a driver integrated circuit 14 formed on one substrate surface (hereinafter referred to as a top surface) of the silicon substrate 12 by using an MOS device such as a bipolar, a CMOS, a BiCMOS, a Power MOS, or the like; a heating resistor 20 composed of a thin film resistor 16 and a thin film conductor 18 and formed in the vicinity of the driver integrated circuit 14; a partitioning wall layer 26 that covers the driver integrated circuit 14 and a portion of the thin film conductor 18, and forms an individual ink passage 22 corresponding to the heating resistor 20 and a common ink passage 24; a plate 28 adhered to the top surface of the partitioning wall layer 26; and an ink jet nozzle 30 corresponding to the heating resistor 20 bored in this plate 28. The ink ejecting head 10 further comprises at least one ink supply port 32 for supplying ink from a surface (hereinafter referred to as a back surface) opposite to the top surface where the heating resistor 20 is provided and an ink groove 34 formed on the top surface side of the silicon substrate 12 to be connected to the ink supply port 32.

The ink supply port 32 is provided on a mounting frame 36 for mounting the ink ejecting head 10, and is in communication with an ink supply path 38 to be connected to an ink cartridge (not shown).

The thin film resistor 16 has a thickness of about 0.1 μm, is made of, for example, a three-element alloy of Ta—Si—O, and is patterned in a predetermined pattern by photo-etching after formation of a thin film layer by using reactive sputtering in argon atmosphere containing oxygen.

The thin film conductor 18 has a thickness of about 1 μm, is made of, for example, Ni metal, and is patterned into a predetermined pattern by photo-etching after formation of a thin film layer by a high speed sputtering method in a high magnetic field so that an individual thin film conductor 18*a* and a common thin film conductor 18*b* are formed. The individual thin film conductor 18*a* is electrically connected to the driver integrated circuit 14.

The partitioning wall layer 26 is formed by laminating a polyimide film having a thickness of, for example, 10 μm and then patterning the film into a predetermined pattern so that the individual ink passage 22 and the common ink passage 24 are formed by photo dry etching using organic silicon-based resist, such as reactive dry etching using oxygen plasma excited by electronic cyclotron resonance. Otherwise, it is also possible to form the partitioning wall layer 26 by application, exposure, development, and curing of photosensitive polyimide.

The plate 28 is, for example, a polyimide film having a thickness of about 30 to 50 μm. The film is adhered to the partitioning wall layer 26 to form the plate 28 and thereafter, a group of ink jet nozzles 30 each having a diameter of, for example, 20 μm are formed by the photo dry etching at a density of about 800 dpi.

The ink groove 34 is a groove extending in one direction for reserving the ink to be ejected from the ink jet nozzles 30 by the heating resistors 20 on the top surface of the silicon substrate 12, and is formed by etching the silicon substrate 12 through sandblasting from the top surface side thereof along the direction in which a plurality of ink jet nozzles are arranged. In order to suppress the flow resistance of the ink and to miniaturize the ink ejecting head 10, the depth of this groove is substantially half the thickness of the silicon substrate 12, for example, 200 to 300 μm.

In order to supply the ink to the ink groove 34, at least one ink supply port 32 is bored for one ink ejecting head 10 in the longitudinal direction of the ink groove 34 by etching the silicon substrate 12 through sandblasting from the back surface side thereof.

The ink supply ports 32 and the ink grooves 34 are both formed by etching using the sandblasting technique, which will be described later.

The ink ejecting head 10 is formed as described above.

Figure 2:
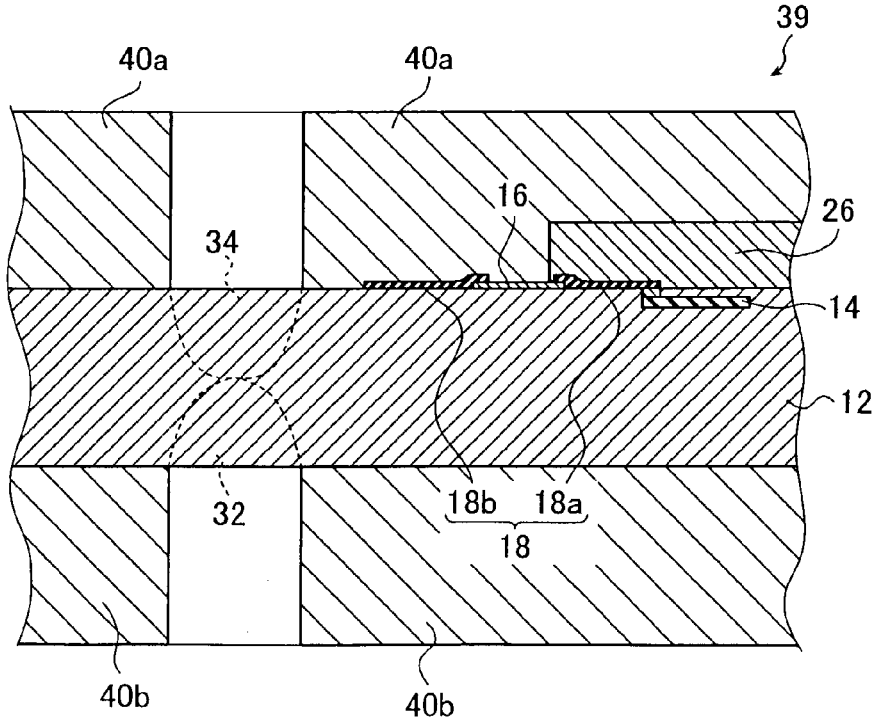
FIG. 2 is a cross-sectional view showing a cross-sectional structure in a manufacturing process of the ink ejecting head manufactured in accordance with the manufacturing method for a liquid drop ejecting head of the present invention.

FIG. 2 shows a substrate 39 made of silicon wafer during the manufacturing process of such an ink ejecting head 10. Referring now to one ink ejecting head 10 shown in FIG. 2, mask layers 40*a* and 40*b* made of an organic material (dry film), which is patterned in a predetermined pattern by a well known method, are provided on both side surfaces of the silicon substrate 12; the driver integrated circuit 14 for ejecting liquid drops is formed underneath the mask layer 40*a;* and at least one ink supply port 32 and the ink groove 34 are formed by sandblasting. In FIG. 2, both surfaces of the silicon substrate 12 are covered by the mask layers 40*a* and 40*b,* and only the parts of the ink supply port 32 and the ink groove 34 to be formed are exposed.

Figure 3:
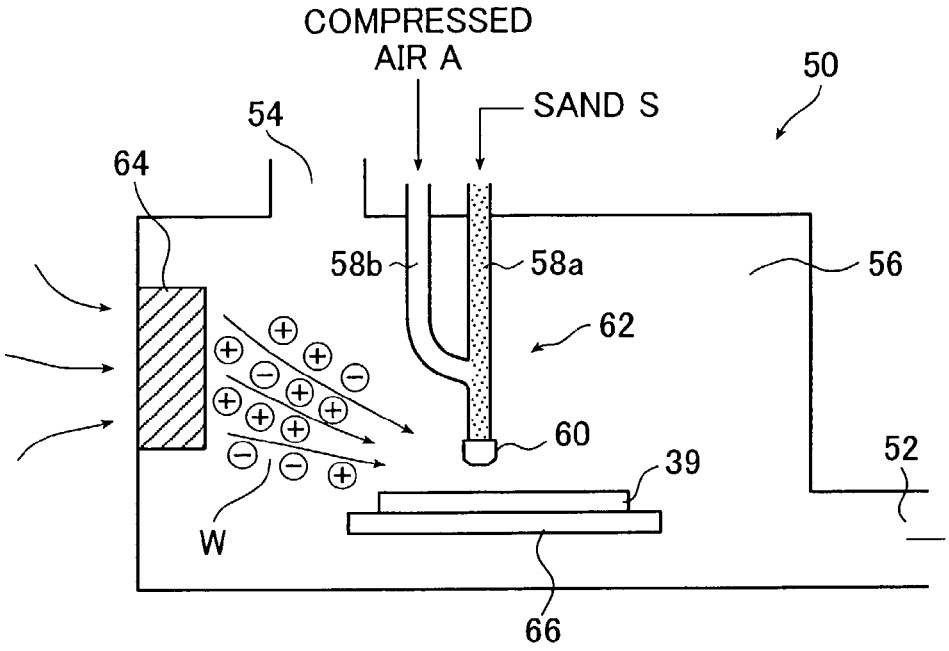
FIG. 3 is a schematic view showing the structure of an embodiment of the manufacturing apparatus for a liquid drop ejecting head according to the present invention.

Such processing of the silicon substrate 12 is performed by means of a sandblasting unit 50 shown in FIG. 3. Namely, the sandblasting unit 50 shows one embodiment of a liquid drop ejecting head manufacturing apparatus according to the present invention.

The sandblasting unit 50 mainly comprises a processing chamber 56 provided with an eject port 52 connected to an eject pump (not shown) and an atmospheric gas inlet port 54; a sandblasting device 62 provided with supply pipes 58*a* and 58*b* for supplying compressed air A and grinding particles (hereinafter referred to as sand) S for sandblasting and a processing nozzle 60 formed at tip end of the supply pipes 58*a* and 58*b;* an ion gas blower 64 for supplying ion blow W for generating ionic atmosphere; and a processing table 66 on which the substrate 39 to be sandblasted is mounted.

The processing nozzle 60 of the sandblasting device 62 is located above the substrate 39 mounted on the processing table 66. The parts exposed from the mask layers 40*a* and 40*b* are subjected to etching by means of the sand S ejected from the processing nozzle 60 to form the ink supply ports 32 and the ink grooves 34. The formation of the ink supply ports 32 and the ink grooves 34 is performed with the substrate surfaces different from each other directed to the processing nozzle 66.

The eject port 52 is connected to the eject pump (not shown) and ejects the air within the processing chamber 56. The atmospheric gas inlet port 54 is used to take in the external atmosphere in response to the air ejection from the eject port 52.

The ion gas blower 64 as one embodiment of the ion gas blowing device of the present invention is a device for supplying the ion blow W toward the surface, facing the processing nozzle 60, of the substrate 39 mounted on the processing table 66.

In this case, the ion gas blower 64 is a device in which the air is ionized by a high voltage corona discharge of a plurality of discharge needles and the ionized air is fed by a fan. The ion gas blower to be employed in the present invention is not particularly limited so long as it can feed the ion blow. Any known ion gas blower may be available.

The ion gas blower 64 is provided with a polarity selection part so that the ion blow has an opposite polarity to the polarity of the charged substrate 39 (plus polarity or minus polarity). For example, the ion blow having plus or minus charge to the same extent is caused to pass through grid electrodes which are given a predetermined polarity, and only the ion having the predetermined polarity is selectively passed therethrough to form the ion blow having the predetermined polarity.

More specifically, the ionized air contains as ion an oxygen molecular nuclear ion $O_2^-$, a carbonic acid nuclear ion $CO_3^-$, a nitric acid nuclear ion $NO_3^-$, a hydrated oxonium ion $H_3O^+ (H_2O)_n$, and the like.

The dry film resist of the mask layers 40*a* and 40*b* provided on both the surfaces of the substrate 39 is made of, for example, a urethane-based organic material. The charged substrate 39 has minus polarity when the sand S is made of SiC. Therefore, the ion gas blower 64 generates the ion blow having predominantly plus polarity in order to remove charge from the charged substrate 39. It is preferable to set one kind of ion in accordance with the polarity of the charged substrate 39.

In the present invention, the sand S to be employed is not particularly limited so long as it is usable as grinding particles for sandblasting and any known particles may be available, although conductive particles are preferred in view of prevention of the substrate 39 from being charged. The sand S as such may be formed from conductive particles such as alumina particles having a surface active agent for imparting the conductive layer to the surfaces of the Sic conductive particles. The conductive particles are used for the sand S so that the charge of the substrate 39 is leaked to the sand S and then ejected from the eject port 52. Thus, the potential of the charged substrate 39 is further lowered.

In this case, the ion blow is directed in one direction, from left to right in FIG. 3, toward the substrate 39 and further to the eject port 52 so that the sand S is not entrained around the discharge needles of the ion gas blower 64, and the blow rate is adjusted. In this case, for example, it is preferable that the charged plate according to ANSI/EOS S3.1-1991 (potential of the charged plate being in the range of 1 kV to 2 kV) be placed in an ionic atmosphere at a position 300 mm away from the blow port of the ion gas blower 64, to adjust the blow rate of the ion blow so that the charged plate may be discharged within one second, preferably within 0.2 seconds, more preferably within 0.1 seconds.

Furthermore, the humidity of the atmosphere within the processing chamber 56 is kept at a relative humidity of 60% or more, preferably 60 to 80%, so that the discharging effect may become more remarkable.

On this occasion, the temperature of an atmosphere, namely the room temperature and so forth, should be kept within a proper range in order to prevent the interior of the sandblasting unit 50, specifically the inside of the processing chamber 56, the supply pipes 58*a* and 58*b* constituting the transportation line for the sand S and the compressed air A, etc., from condensation.

The reason why a relative humidity of 60 to 80% is preferred is as follows: With a relative humidity of under 60%, charging due to the friction between the sand S and the compressed air A may adversely affect the substrate 39 and, on the other hand, a relative humidity of excessively high value may cause the sand S to form agglomerations each consisting of several sand particles. Such agglomerations of the sand S, as being ejected from the processing nozzle 60, may affect some of processing properties or have various adverse effects such as of adhering inside the processing chamber 56, which makes the cleaning of the inside of the processing chamber 56 very hard.

In the foregoing embodiment, in the sandblasting unit 50, the ionic atmosphere is produced around the substrate 39 by blowing with the ion blow using the ion gas blower 64. However, it is also possible to ionize the compressed air in itself that is to be used for sandblasting. The ionization may be performed by means of the high voltage corona discharge of the discharge needles in the same manner as in the ion gas blower 64.

Figure 4:
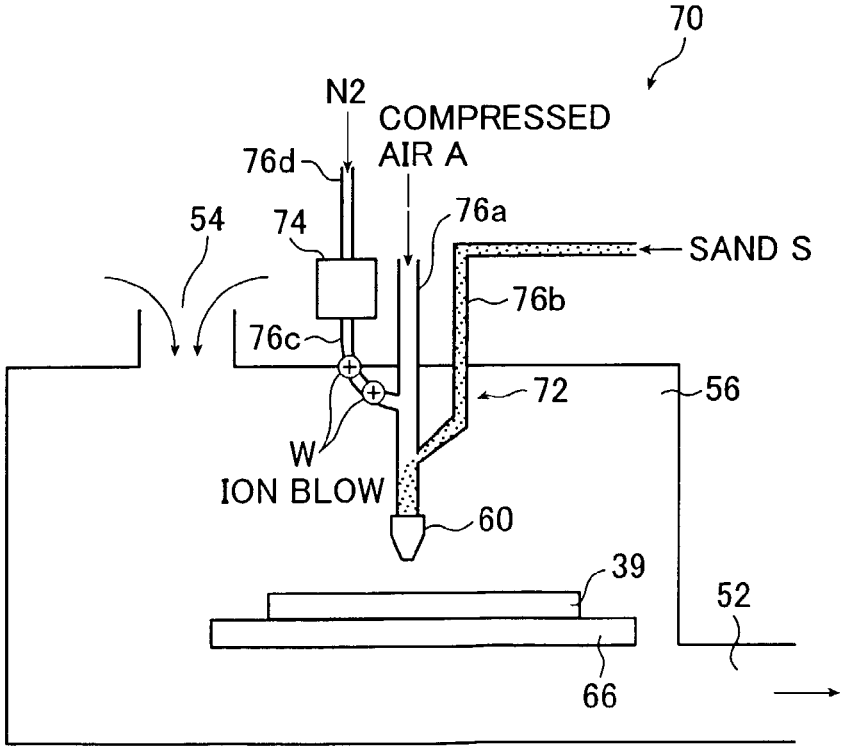
FIG. 4 is a schematic view showing the structure of another embodiment of the manufacturing apparatus for a liquid drop ejecting head according to the present invention.

FIG. 4 shows an embodiment of the sandblasting unit in which the compressed air for sandblasting is ionized in itself.

A sandblasting unit 70 as shown in FIG. 4 is identical to the sandblasting unit 50 in FIG. 3 except that it comprises a sandblasting device 72 provided with an ion generator 74 instead of the sandblasting device 62 and the ion gas blower 64. Consequently, like components are denoted by corresponding numerals in the figure and the explanation of them is omitted. In the following, the differences between the two sandblasting units 50 and 70 are principally described.

The sandblasting unit 70 as shown in FIG. 4 mainly comprises a processing chamber 56 provided with an eject port 52 and an atmospheric gas inlet port 54; the sandblasting device 72 provided with the ion generator 74; and a processing table 66 for a substrate 39.

The sandblasting device 72 comprises a processing nozzle 60; a main supply pipe 76*a* for supplying compressed air A fitted at its tip end with the processing nozzle 60; supply pipes 76*b* and 76*c*, each branching off from the main supply pipe 76*a*, for supplying sand S and ion blow W, respectively, either of the sand S and the ion blow W being to be mixed with the compressed air A in the main supply pipe 76*a*; the in-line type ion generator 74 connected to the supply pipe 76*c* for the ion blow W; and a supply pipe 76*d* for supplying nitrogen ($N_2$) gas connected to the ion generator 74.

In the sandblasting device 72, the compressed air A in the main supply pipe 76*a* as the main line for compressed air for processing is mixed with the ion blow W generated in the in-line type ion generator 74 and introduced from the supply pipe 76*c* so that the compressed air A for processing is ionized. To the compressed air A for processing in the main supply pipe 76*a* after ionization by the introduction of the ion blow W, the sand S is fed from the supply pipe 76*b* and mixed therewith. As a consequence, the sand S which is entirely or substantially prevented from being charged is ejected (blasted) from the processing nozzle 60 together with the compressed air A, thus the sandblasting process being performed on the substrate 39 mounted on the processing table 66.

Any ion generator of the in-line type may be employed in the present invention as the in-line type ion generator 74 so long as it can ionize a carrier gas such as nitrogen ($N_2$) gas and the air fed from the supply pipe 76*d* by means of the high voltage corona discharge so as to generate the ion blow. For instance, ion generators produced by the IMPREX Corporation, especially those of the air-nozzle type, are available.

In the sandblasting unit 70 as shown in FIG. 4, it is preferable to set the distance from the ion generator 74 to the substrate (wafer to be processed) 39 on the processing table 66 to 50 cm or less for the purpose of preventing the recombination of ions and realizing an efficient and effective discharge. Naturally, it is desirable in the sandblasting unit 50 in FIG. 3 to set the distance from the ion gas blower 64 to the substrate 39 on the processing table 66 to 50 cm or less.

The sandblasting unit used in the present invention is basically constructed as described above.

Figure 5:
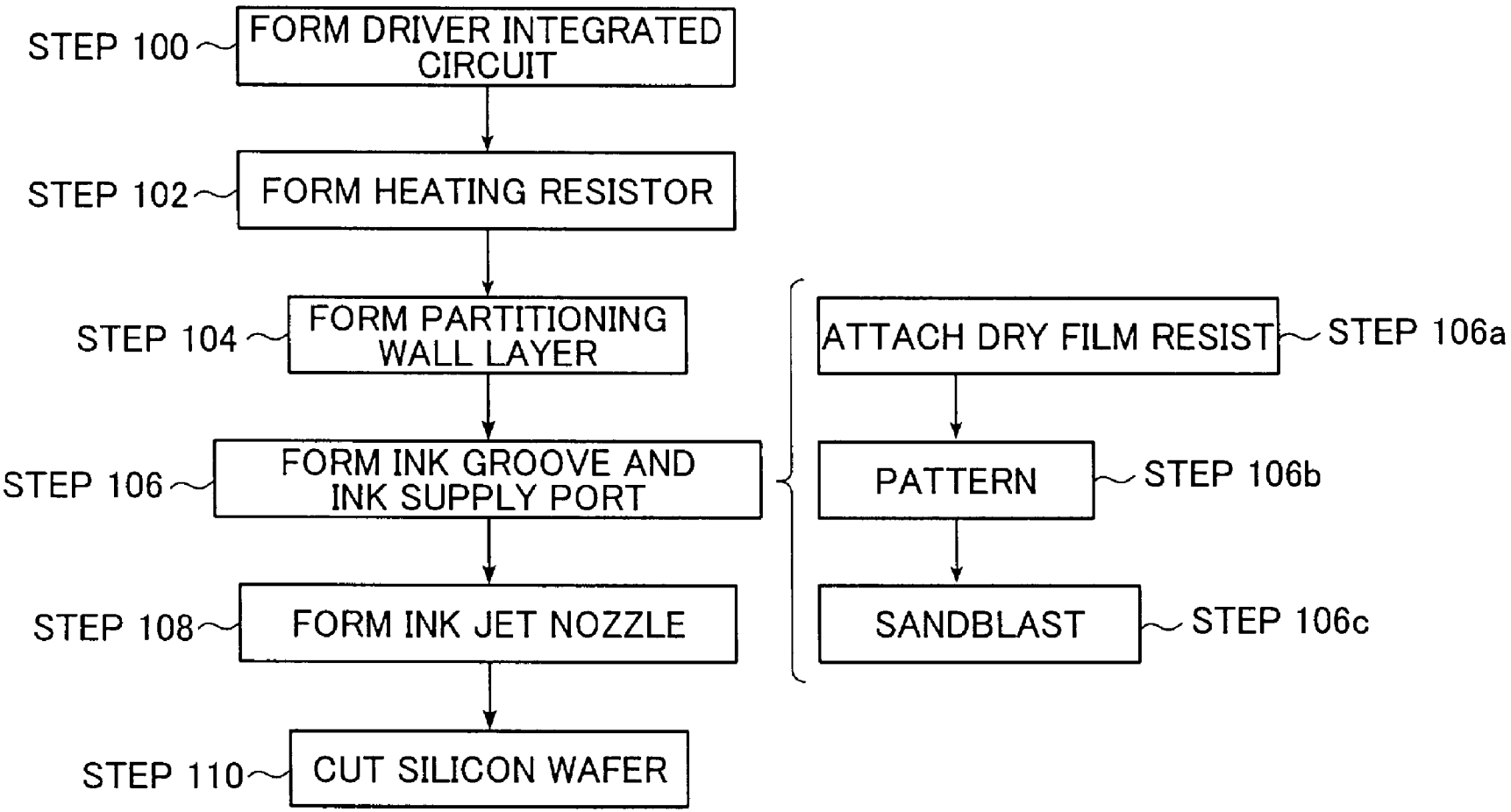
FIG. 5 is a flowchart showing a flow of the manufacturing method of the ink ejecting head that is one example of the manufacturing method for a liquid drop ejecting head according to the present invention.

As shown in the flowchart of the manufacturing process in FIG. 5, in such ink ejecting heads 10, a plurality of driver integrated circuits 14 are formed in predetermined positions on the silicon wafer (silicon substrate 12) using predetermined semiconductor processing techniques (step 100), and thereafter the thin film resistors 16 are formed by the reactive sputtering method and the photo etching method. Then, the thin film conductors 18 are formed by the high speed sputtering method and the photo etching method to form the heating resistors 20 (step 102).

Thereafter, a polyimide film is laminated on the silicon wafer (12) provided with the heating resistors 20 and patterned in a predetermined pattern by the reactive dry etching to thereby form the partitioning wall layer 26 (step 104).

Subsequently, the ink grooves 34 and the ink supply ports 32 are formed by the sandblasting method (step 106).

Namely, first of all, a dry film resist is attached onto each of the top surface and the back surface of the silicon wafer (12) as the mask layers 40*a* and 40*b* for use in the sandblasting process (step 106*a*). In this case, the dry film resist is, for example, an acrylic urethane-based resin film having a negative photo resist function that may be developed in an alkaline solution.

The dry film resist attached to the silicon wafer (12) is subjected to the exposure and development so that the patterning is effected in such a manner that mask layers having a predetermined shape are formed (step 106*b*). Examples of the solution to be used in development include alkaline solutions such as 0.1–5% sodium carbonate aqueous solution and tetra methyl ammonium hydroxide (TMAH) solution. Since the driver integrated circuits 14 are formed underneath the dry film resist, it is particularly preferable to use TMAH solution that does not contain Na ion. The development of such solution is performed by spraying the silicon wafer with, for example, 0.2% TMAH solution at a spray pressure of 2 kg/cm$^2$.

Thus, the dry film resist is patterned into a predetermined pattern, that is, parts of the silicon substrate surface where the ink supply ports 32 and the ink grooves 34 are to be formed are exposed from the mask layers 40*a* and 40*b* of the dry film resist.

Thereafter, the substrate 39 that is the silicon wafer (12) having the dry film resist patterned as the mask layers 40*a* and 40*b* is mounted on the processing table 66 of the processing chamber 56, the sand S is blasted together with the compressed air A from the processing nozzle 60, and the exposed parts of the substrate 39 are subjected to etching so that the ink supply ports 32 and the ink grooves 34 are formed.

In this case, the substrate 39 is charged to have a certain polarity by means of the sand S but since the ion blow having predominantly the polarity opposite to the polarity of the charged substrate 39 is blowed from the ion gas blower 64, the charge of the substrate 39 is removed and the potential of the charged substrate 39 is not elevated. Accordingly, there is no fear that the driver integrated circuit 14 would be damaged electrostatically. For example, if the ion blow is not used, the potential of the charged substrate 39 is kept at −1 kV or more and the driver integrated circuit 14 is damaged electrostatically. However, since the ion blow is used, the potential of the charged substrate 39 is lowered to the level of −40V to −200V, the electrostatic damage of the driver integrated circuit 14 no longer occurs. In this case, the absence/presence of the electrostatic damage of the driver integrated circuit 14 is judged by inspecting, for example, the characteristics of the integrated circuit used in the driver integrated circuit 14 such as the threshold voltage of the logic circuit produced in the integrated circuit, and the characteristics of the MOS device used in the driver integrated circuit 14 such as the gate voltage dependency of the drain current of the MOS-FET before and after the sandblasting.

Upon etching of the substrate 39 by the sandblasting unit 50 or 70, the substrate 39 can be subjected to the etching process through its entire surface if, for instance, the processing nozzle 60 for blasting the sand is allowed to carry out raster scanning over the substrate 39. In that case, assuming that the sand S is blasted onto the substrate 39 with the effective processing area having a diameter of 10 mm and the raster scanning is carried out with such an area at a linear velocity of 50 mm/sec, the sand S continues to be blasted onto one spot on the substrate 39 for about 0.2 seconds.

Again in the case as above, the substrate 39 can be entirely or substantially prevented from being charged by adjusting the blow rate of the ion blow so that the charged plate according to ANSI/EOS S3.1-1991 may be discharged preferably within 0.2 seconds, more preferably within 0.1 seconds. As a result, the potential of the charged substrate 39 is in any case not so increased as the electrostatic damage of the driver integrated circuits 14 occurs.

The substrate 39 having the dry film resist is subjected to the etching (sandblasting) for forming the ink supply ports 32 and the ink grooves 34 (step 106*c*). There is no special limit to the order of processing of the ink supply ports 32 and the ink grooves 34 but it is preferable to start with the processing of the ink supply ports 32.

After the formation of the ink supply ports 32 and the ink grooves 34 by the sandblasting, it is preferable to remove the mask layers 40*a* and 40*b* of the dry film resist by the alkaline solution such as 0.1–5% sodium carbonate aqueous solution, tetra methyl ammonium hydroxide (TMAH) solution, or 5–20% mono ethanol amine solution, more preferably, ca. 5% mono ethanol amine solution.

Thereafter, the plate 28 is adhered to the top surface of the partitioning wall layer 26 and the ink jet nozzles 30 having a predetermined nozzle diameter are formed by the photo dry etching (step 108).

Finally, the silicon wafer is cut into a predetermined size (step 110), and is divided into head chips for the ink ejecting heads and each head chip is actually mounted on the mounting frame 36.

Note that, in the foregoing embodiments, the example of forming the ink supply ports 32 and the ink grooves 34 of the ink ejecting heads 10 has been explained, but the present invention is not limited to the formation of the ink supply ports 32 and the ink grooves 34 for supplying ink and is applied to any sandblasting process that is needed in manufacturing the ink ejecting heads. Furthermore, the present invention can be also applied to the manufacture of the liquid drop ejecting head in which the mask layers made of an organic material are used to perform sandblasting on the substrate surfaces thereby forming the liquid supply grooves or the like through etching.

In addition, in the foregoing embodiments, the sandblasting process is performed using grinding particles (sand) so as to forming liquid supply grooves etc. by etching during manufacturing ink ejecting heads and liquid drop ejecting heads. The present invention is, however, not limited to the embodiments as above but is also applicable to cases of etching a masked substrate using particles of ice or dry ice.

The method and the apparatus for manufacturing a liquid drop ejecting head according to the present invention have been described in detail with reference to various embodiments. However, the present invention is not limited to the above-described embodiments and of course, it is possible to change or modify the invention without departing from the scope and the spirit of the invention.

As described above in detail, according to the present invention, since the etching process such as sandblasting is performed in the ionized atmosphere having the polarity opposite to the polarity that the substrate is supposed to have in advance, the substrate can be entirely or substantially prevented from being charged and the potential of the charged substrate, i.e., the potential of the charged driver circuit formed on the substrate can be reduced to thereby prevent the generation of the electrostatic damage of the driver circuit.

Furthermore, according to the present invention, the particles used in sandblasting are made conductive so that the charge of the charged substrate leaks to the conductive particles and the electrostatic damage of the driver circuit may further be suppressed.

What is claimed is:

1. A manufacturing method for a liquid drop ejecting head, comprising:

blasting particles on a substrate having on an upper layer a patterned mask layer made of an organic material and on a lower layer a driver circuit for ejecting a liquid drop; and thereby performing an etching process on parts of the substrate exposed from the mask layer, wherein said etching process is performed in an ionic atmosphere ionized with a polarity opposite to a charged polarity generated in said substrate when said substrate is subjected to etching.

2. The manufacturing method for a liquid drop ejecting head according to claim 1, wherein said ionic atmosphere is produced by blowing ion blow toward a substrate surface of said substrate.

3. The manufacturing method for a liquid drop ejecting head according to claim 1, wherein said ionic atmosphere is produced by ionizing compressed air for blasting particles during the etching process.

4. The manufacturing method for a liquid drop ejecting head according to claim 1, wherein said particles are conductive particles.

5. The manufacturing method for a liquid drop ejecting head according to claim 1, wherein said etching process is a sandblasting process.

6. The manufacturing method for a liquid drop ejecting head according to claim 2, wherein said ionic atmosphere is produced by ionizing compressed air for blasting particles during the etching process.

7. The manufacturing method for a liquid drop ejecting head according to claim 1, wherein humidity of said ionic atmosphere is kept at a relative humidity of 60% or more.

8. The manufacturing method for a liquid drop ejecting head according to claim 1, wherein humidity of said ionic atmosphere is kept at a relative humidity of 60% to 80%.

9. The manufacturing method for a liquid drop ejecting head according to claim 2, wherein a blow rate of said ion blow is adjusted that a charged plate according to ANSI/EOS S3.1-1991 that a potential of said charged plate being in a range of 1 kV to 2 kV is placed in an ionic atmosphere at a position of 300 mm away from a blow port of said ion blow, so that said charged plate is discharged within one second.

10. The manufacturing method for a liquid drop ejecting head according to claim 9, wherein said blow rate of said ion blow is adjusted so that said charged plate is discharged within 0.2 seconds.

11. The manufacturing method for a liquid drop ejecting head according to claim 9, wherein said blow rate of said ion blow is adjusted so that said charged plate is discharged within 0.1 seconds.

12. A manufacturing apparatus for a liquid drop ejecting head having:

an etching device for blasting particles on a substrate having on an upper layer a patterned mask layer made of an organic material and on a lower layer a driver circuit for ejecting a liquid drop and for etching parts of the substrate exposed from the mask layer; and an ion gas blowing device for blowing ion blow ionized with a polarity opposite to a charged polarity generated in the substrate toward a substrate surface of said substrate to be etched by the etching device.

13. The manufacturing apparatus for a liquid drop ejecting head according to claim 12, wherein said ion gas blowing device is an ion gas blower for blowing said ion blow toward the substrate surface of said substrate separately from compressed air for blasting particles upon etching by said etching device.

14. The manufacturing apparatus for a liquid drop ejecting head according to claim 12, wherein said ion gas blowing device ionizes compressed air for blasting particles upon etching by said etching device so as to provide the ion blow and blows it.

15. The manufacturing apparatus for a liquid drop ejecting head according to claim 12, wherein said particles are conductive particles.

16. The manufacturing apparatus for a liquid drop ejecting head according to claim 12, wherein said etching device is a sandblasting device.

17. The manufacturing apparatus for a liquid drop ejecting head according to claim 13, wherein a blow rate of said ion gas blower is adjusted that a charged plate according to ANSI/EOS 53.1-1991 that a potential of said charged plate being in a range of 1 kV to 2 kV is placed in an ionic atmosphere at a position of 300 mm away from a blow port of said ion gas blower, so that said charged plate is discharged within one second.

18. The manufacturing apparatus for a liquid drop ejecting head according to claim 17, wherein said blow rate of said ion gas blower is adjusted so that said charged plate is discharged within 0.2 seconds.

19. The manufacturing apparatus for a liquid drop ejecting head according to claim 17, wherein said blow rate of said ion gas blower is adjusted so that said charged plate is discharged within 0.1 seconds.

20. The manufacturing apparatus for a liquid drop ejecting head according to claim 12, wherein humidity of said ionic atmosphere is kept at a relative humidity of 60% or more.

21. The manufacturing apparatus for a liquid drop ejecting head according to claim 12, wherein humidity of said ionic atmosphere is kept at a relative humidity of 60% to 80%.

* * * * *